US005293204A

United States Patent [19]

Tabuchi

[11] Patent Number: 5,293,204

[45] Date of Patent: Mar. 8, 1994

[54] COPIER WITH A SUPERPOSED-SHEET SEPARATION MECHANISM

[75] Inventor: Hiroshi Tabuchi, Amagasaki, Japan

[73] Assignee: Mitsubishi Denki Kabushiki Kaisha, Tokyo, Japan

[21] Appl. No.: 975,165

[22] Filed: Nov. 12, 1992

Related U.S. Application Data

[63] Continuation of Ser. No. 779,832, Oct. 21, 1991, abandoned.

[30] Foreign Application Priority Data

Oct. 25, 1990 [JP] Japan ..... 2-290464

[51] Int. Cl.[5] ..... G03G 15/00

[52] U.S. Cl. ..... 355/309; 271/10; 271/18

[58] Field of Search ..... 355/308, 309, 317; 271/10, 18, 109, 38, 264, 265

[56] References Cited

U.S. PATENT DOCUMENTS 4,113,244 9/1978 Ruenzi ..... 271/4
5,011,127 4/1991 Hamilton et al. ..... 271/265 X
5,022,642 6/1991 Hasegawa et al. ..... 271/10
5,043,771 8/1991 Shibata et al. ..... 355/317
5,055,885 10/1991 Yoshikado et al. ..... 355/309 X

FOREIGN PATENT DOCUMENTS 3542712 6/1986 Fed. Rep. of Germany .
52378 10/1988 Japan .

*Primary Examiner*—A. T. Grimley
*Assistant Examiner*—Sandra L. Brasé
*Attorney, Agent, or Firm*—Rothwell, Figg, Ernst & Kurz

[57] ABSTRACT

In a copier having a sheet pick-up roller for picking up sheets one by one from a paper cassette, and a writing section, where an image is written on the sheet, a sheet separation mechanism is disposed between the sheet pick-up roller and the writing section to separate the sheets when a plurality of sheets are picked up in superposition. A sensor is disposed between the separation mechanism and the writing section, the initiation of the writing is timed to occur with the arrival, at the writing section, of the leading end of the area of the sheet in which the toner image is to be written.

5 Claims, 4 Drawing Sheets

COPIER WITH A SUPERPOSED-SHEET SEPARATION MECHANISM

This is a continuation of application Ser. No. 07/779,832, filed Oct. 21, 1991, now abandoned.

FIELD OF THE INVENTION

The present invention relates to a copier in which sheets stacked in a sheet cassette are conveyed one by one to a writing section, where an image is written on each sheet.

BACKGROUND OF THE INVENTION

In an example of conventional copier, shown for example in Japanese Patent Kokoku Publication 52378/1988, cut sheets on which a visible image is to be written are contained in a paper cassette and are picked up one by one by means of a pick-up roller and fed, via a conveyance path, to a writing section where a visible image is written by transferring a toner image from a photosensitive drum 41. A problem associated with the conventional copier is that a plurality of sheets, rather than just one, may accidentally be picked up simultaneously by the pick-up roller. This will result in a jamming in the conveyance path and the writing may be unsuccessful.

An object of the present invention to provide a copier in which jamming of sheets are prevented, and it is ensured that the writing on the sheets be successful even if a plurality of sheets are picked up by mistake, or otherwise supplied in superposition.

A copier according to the invention comprises:

a sheet supply means for supplying sheets in succession;

a writing section, where an image is written on the sheet;

characterized by further comprising:

a sheet separation mechanism disposed between the sheet supply means and the writing section to separate the sheets into ones when a plurality of sheets are supplied in superposition from the sheet supply means;

a sheet sensor producing a signal indicative of the passage of the sheet through a predetermined location between the sheet separation mechanism and the writing section; and a control means for controlling the timing of the writing such that the initiation of the writing is in time with the arrival, at the writing section, of the leading end of the area of the sheet in which the image is to be written.

In the copier configured as described above, when a plurality of sheets are supplied in superposition, they are separated into individual sheets by the separation mechanism, and are sent out from the separation mechanism one after another. Moreover, the passage of each of the separated sheet sent out of the separation mechanism through a predetermined location upstream of the writing section is detected by the sensor, so the initiation of writing of image onto the sheet is in time with the arrival, at the writing section, of the leading end of the area of the sheet where the image is to be written, so the synchronization of the writing with the sheet feeding is ensured, even for the second and any subsequent superposed sheets which are simultaneously supplied and separated at the separation mechanism.

DETAILED DESCRIPTION OF THE PREFERRED EMBODIMENTS

Figure 1:
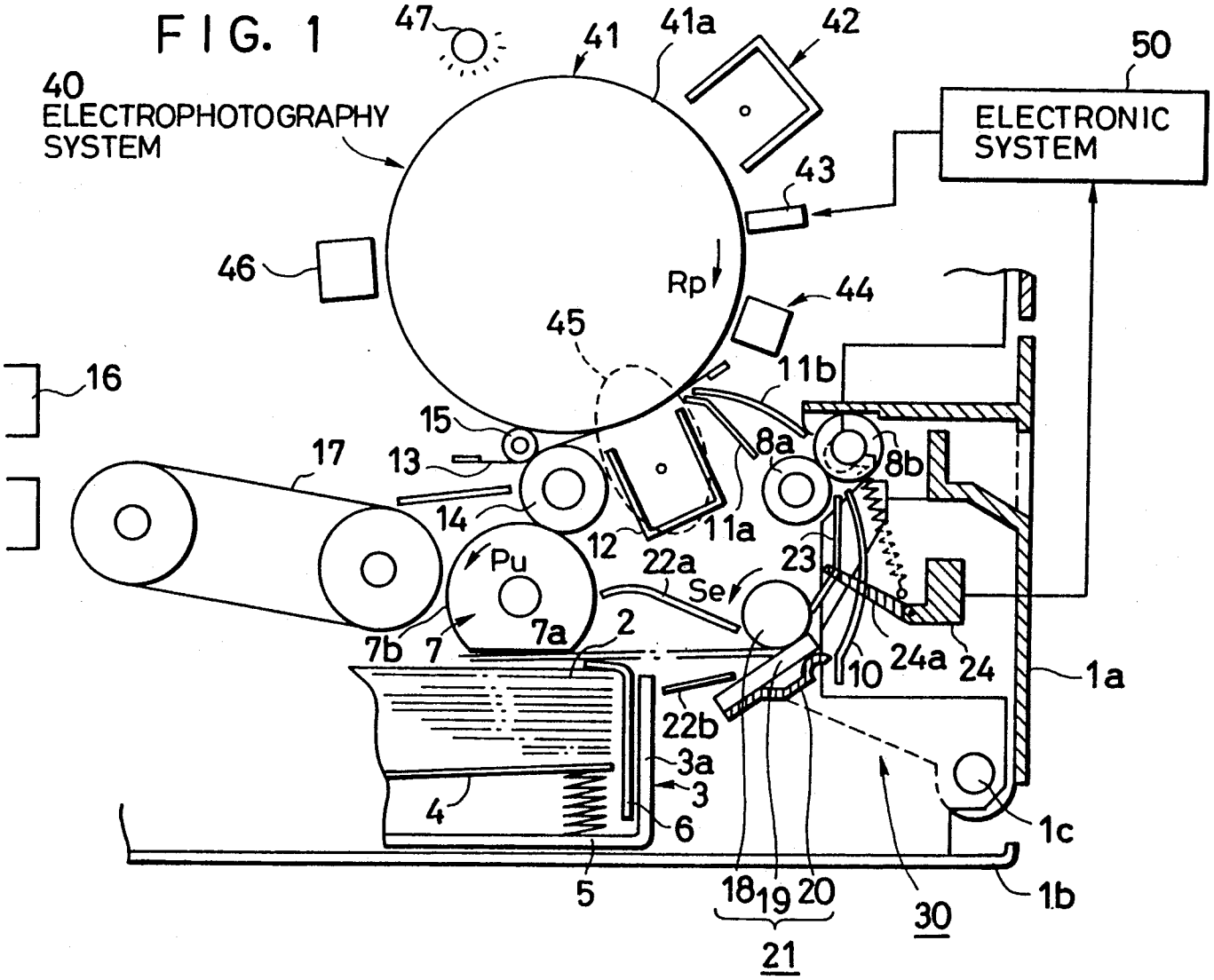
FIG. 1 is a schematic sectional view of the pertinent portion of a copier according to an embodiment of the invention.

An embodiment of the invention will now be described with reference to drawings.

The copier of the illustrated embodiment is a telecopier, and comprises an electronic system 50, an electrophotography system 40, and a paper feed system 30, which are accommodated in or attached to a housing formed of an upper cover 1*a* and a lower cover 1*b*. The housing can be opened by rotating the upper cover 1*a* relative to the lower cover 1*b* about a shaft 1*c*. Some of the components are attached to the upper cover 1*a* while others are attached to the lower cover 1*b*.

The electronic system 50 is not illustrated in detail, but it comprises, as is well known, means receiving image data over a telecommunication line from another telecopier, means for processing the image data, and means for producing the image data in the form suitable for input to the electrophotography system 40.

The electronic system 50 further comprises a control means which controls the operation of the entire copier.

The electrophotography system 40 comprises a photosensitive drum 41, which is rotatably mounted to the upper cover 1*a*, and rotates in a direction indicated by arrow Rp. During the rotation its cylindrical surface 41*a* having a photosensitive layer successively passes by a charger 42, an exposure device 43, a developer 44, a transfer device 12, a cleaning device 46 and a discharger 47.

The charger 42 uniformly charges the cylindrical surface 41*a* of the photosensitive drum 41.

The exposure section 43 exposes the cylindrical surface 41*a* of the photosensitive drum 41 to a pattern of light, thereby to form an electrostatic latent image on the surface of the photosensitive drum 41. The exposure device 43 may comprise an LED array which receives image data from the electronic system 50 to form linear patterns of light, a succession of the linear patterns forming a two-dimensional image to be written on one sheet of paper, which is called a frame of image.

The developer 44 forms a toner image corresponding to the electrostatic latent image on the cylindrical surface 41*a* of the photosensitive drum 41.

The location where the transfer device 12 faces the photosensitive drum 41 forms a transfer section 45. At the transfer section 45, a sheet 2 is brought into contact with the cylindrical surface 41*a* of the photosensitive drum 41, in a manner later described in detail, and the toner image is transferred from the photosensitive drum 41 to the sheet 2.

The transfer device may comprise a corona charger which applies electrostatic charges (of a polarity opposite to the polarity of the charges forming the electrostatic latent image) to the sheet by corona discharge from the corona charger 41*a*, and thereby attracts the toner image on the photosensitive drum 41 to the sheet 2.

The cleaning device 46 removes any residual toner from the photosensitive drum 41.

The discharger 47 removes any residual electrostatic charge from the photosensitive drum 41.

The paper feed system 30 comprises a paper cassette 3 from which cut sheets 2 are picked up one by one, and conveyed through a conveyance path to the transfer section, where the toner image is transferred to the sheet 2, and the sheet 2 is then passed to a fixing device 16, where the toner image is fixed.

The paper cassette 3 is removably mounted to the lower cover 1*b*, and accomodates a stack of cut sheets 2.

A pick-up roller 7 picks up the sheets 2 one by one from the cassette 3. More specifically, the stack of sheets 2 are placed on an intermediate plate 4 disposed within the cassette case 3*a*. The intermediate plate 4 is pushed up by a spring 5 so that the stack of sheets 2 are pushed upward. A sheet separation nail 6 is fixed to engage with the leading ends of the stack of sheets 2, thereby restraining upward movement of the leading ends of the stack of sheets, and the height or level of the uppermost sheet 2 is kept constant.

The pick-up roller 7 is in the form of a cylinder having a portion 7*a* partially cut away to form a flat part over a certain angular range. The pick-up roller 7 is in pressure-contact with the uppermost sheet 2 of the stack of sheets, except when its cut-away portion 7*a* is facing the sheet, and as it rotates, in the direction indicated by arrow Pu, it pulls the uppermost sheet 2 by friction. When the cut-away portion 7*a* is facing the sheet, the contact pressure is insufficient and the sheet 2 is not pulled. The cut-away portion 7*a* is provided to determine the timing at which the sheet begins to be fed. As the leading edge 7*c* of the cylindrical part 7*b* of the surface of the pick-up roller 7 comes into contact with the sheet 2, the sheet begins to be fed, and only the uppermost sheet is pulled and picked up. The separation of the uppermost sheet from the remaining sheets is assisted by the separation nail 6. It should however be noted that although the pick-up roller 7 is designed to and expected to pick up one sheet at at time, it sometimes happens that two or more sheets may be accident be picked up simultaneously, and fed to the conveyance path in superposition.

Once the leading end of the sheet is clamped and begins being driven by a roller, such as register rollers 8*a* and 8*b*, to be described later, in the conveyance path, the friction by the pick-up roller 7 is no longer required. The pick-up roller 7 rotates twice, and at the end of the two rotations, the sheet is now driven by the register rollers 8*a* and 8*b*. Until the trailing end of the sheet clears the pick-up roller after the leading end reaches the fixing device 16. Until then, the pick-up roller 7 is not in contact with and is unable to pick up the subsequent sheet even if it is rotated. The pick-up roller 7 is driven after the trailing end of the preceding sheet 2 clears the pick-up roller 7.

The sheet 2 that has been picked up is conveyed through the conveyance path as described above.

Provided by the conveyance path are a guide plates 22*a* and 22*b*, a separation mechanism 21, a movable guide plate 10, a fixed guide plate 23, a sensor 24, the register rollers 8*a*, 8*b*, and guide plates 11*a* and 11*b*.

The guide plates 22*a* and 22*b* guide the sheets 2 fed out of the pick-up roller 7, to the separation mechanism 21.

The separation mechanism 21 is for separating any superposed sheets (sheets in superposition picked up simultaneously) into individual sheets, and feeds the sheets one by one toward the transfer section 45.

The separation mechanism comprises a drive roller 18, a friction piece 19 and a pressing piece 20. The drive roller 18 rotates in the direction of arrow Se, assisting the travel, along the conveyance path, of the sheet or the uppermost one of the sheets in superposition. The cylindrical surface 18*a* of the roller 18 is formed of a material having a friction sufficient to drive the sheet 2 out of the separation mechanism 21, as will be discussed later. An example of the material suitable for the roller 18 is chloroprene sponge rubber.

The friction piece 19 is formed of a material having a friction sufficient to resist the travel of the sheet other than the uppermost sheet, when two or more sheets have been fed to the separation mechanism 21, as will be later discussed in further detail. Examples of the material suitable for the friction piece 19 is urethane rubber and chloroprene rubber.

Figure 2A:
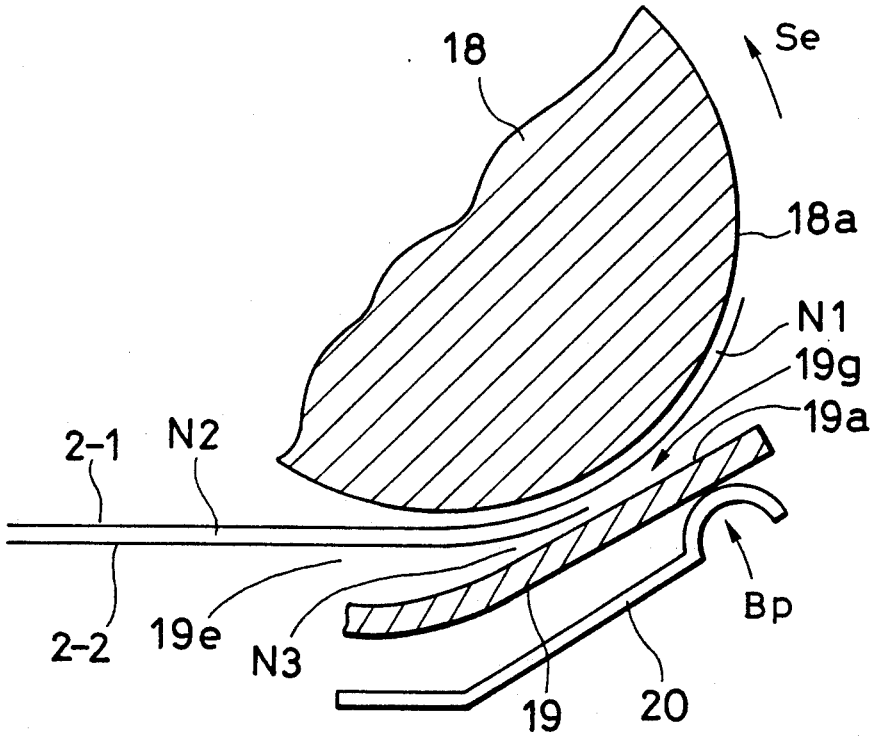
FIG. 2A and FIG. 2B are partial enlarged views of the separation mechanism shown in FIG. 1.
Figure 2B:
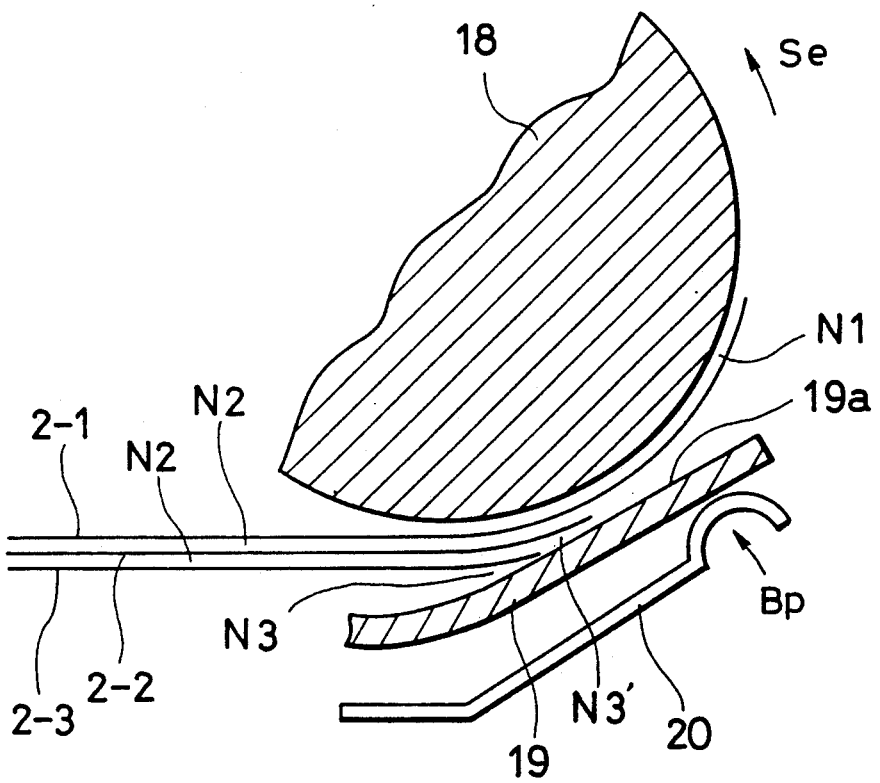

The pressing piece 20 is formed of a plate spring or the like, and presses the friction piece 19, as indicated by arrow Bp in FIG. 2A and FIG. 2B, against the cylindrical surface of the roller 18.

The friction piece 19 has a surface 19*a* having a flat part which is oriented obliquely with respect to the incoming sheets, i.e., the direction in which the sheets are fed toward the separation mechanism 21. As is better illustrated in FIG. 2A and FIG. 2B, a sheet accepting cavity 19*e* is defined by the cylindrical surface 18*a* of the drive roller 18 and the surface 19*a* of the friction piece 19 on an entry side on which the sheets supplied from the pick-up roller 7 are received. The sheet accepting cavity 19*e* is tapered toward a narrow gap 19*g* which is formed between the cylindrical surface 18*a* of the drive roller 18 and the flat surface 19*a* of the friction piece 19, and the sheets 2 are allowed to pass the gap 19*g* one at a time, as will be clear from the following description. More specifically, as the leading ends of superposed sheets reach the gap 19*g*, only the uppermost sheet is allowed to pass the gap 19*g*, while other sheets are retained. When the uppermost sheet 2-1 completes the passage through the gap, i.e., its trailing end clears the gap, the next sheet which is now uppermost is allowed to pass. This process is repeated until all the superposed sheets pass the gap. Then the next sheet is fed from the cassette 3.

More specifically, when two sheets are in superposition, as shown in FIG. 2A, the lower sheet 2-2 is in contact with the friction piece 19 over a considerable length. The friction force N1 between the drive roller 18 and the upper sheet 2-1 is greater than the friction force N2 between the upper and the lower sheets 2-1 and 2-2. Moreover, the friction force N3 between the friction piece 19 and the lower sheet 2-2 is greater than the friction force N2 between the upper and the lower sheets 2-1 and 2-2. The upper sheet 2-1 is therefore moved forward, while the lower sheet 2-2 is retained. When the upper sheet 2-1 completes the passage through the gap 19*g*, the sheet 2-2 will then be the only sheet in the sheet accepting cavity 19*e*, and is fed by friction of the drive roller 18.

The friction N1 between the drive roller 18 and the sheet is greater than the friction N3 between the friction piece 19 and the sheet 2, so that a single sheet (not in superposition) in the cavity 19*e*, and hence in contact both with the drive roller 18 and the friction piece 19 is moved forward.

When three sheets are in superposition, as shown in FIG. 2B, the lowermost sheet 2-3 is in contact with the friction piece 19 over a considerable length. The intermediate sheet 2-2 will be in a state as illustrated in FIG. 2B in which it is in contact with the friction piece 19 only at its leading end, with the lowermost sheet 2-3 being retarded by the friction N3 with the friction piece 19 as well as the oblique orientation of the friction piece 19 and the tapered cavity 19*e*. The friction force N3' between the intermediate sheet 2-2 with the friction piece 19 is still greater than the friction force N2 between the uppermost sheet 2-1 and the intermediate sheet 2-2. The uppermost sheet 2-1 is therefore moved forward while other sheets are retained in the cavity 19*e*. When the uppermost sheet 2-1 moves out of the cavity 19*e*, the situation will then be identical to that shown in FIG. 2A, and the subsequent operation is identical to that described with reference to FIG. 2A.

The fixed guide plate 23 and the movable guide plate 10 guides the sheet 2 having passed the separation mechanism 21, to the register rollers 8*a* and 8*b*.

The sensor 24 detects passage of the leading end of the sheet 2 through a location within the guide plates 23 and 10. More specifically, the sensor 24 comprises an arm 24*a* which is rotated clockwise as seen in FIG. 1 by being pushed by the end of the leading end of the sheet, and a photocoupler, not shown as such, detecting the rotation of the arm 24*a* produces an electrical signal indicating the passage of the leading end of the sheet. When the trailing end of the sheet clears the arm 24*a*, the arm 24*a* returns, by the action of gravity, to the original, free position to be ready for detection of the next sheet.

The sensor 24 may be provided at another location between the separation mechanism 21 and the transfer section 45.

The register rollers 8*a* and 8*b* pinch the sheet 2 between them with a high pressure, and ensures that the sheet 2 be moved forward, at a speed identical to the peripheral speed of the photosensitive drum 41.

The guide plate 11*a* and 11*b* guide the sheet 2 having passed the register rollers 8*a* and 8*b* to the transfer section 45.

At the transfer section 45, the sheet 2 is brought into contact with the cylindrical surface 41*a* of the photosensitive drum 41. The contact of the sheet 2 with the cylindrical surface 41*a* of the photosensitive drum 41 is ensured by the tip of the guide 11*a* and an exit roller 14. While the sheet 2 is in contact with the cylindrical surface 41*a*, the toner image is transferred to the sheet 2, as described above. It is necessary that the leading end of the toner image on the cylindrical surface 41*a* arrives at the transfer section 45 at the same time with the leading end of the area of the sheet 2 in which the toner image is to be transferred arrives. This is achieved by initiating exposure of the photosensitive drum 41 to the first one of the succession of linear light patterns forming a frame of image, in accordance with the output of the sensor 24, with the photosensitive drum 41 being kept rotating at a constant speed. For instance, the exposure to the first one of the succession of linear light patterns of a frame of image (image for one sheet) is commenced immediately upon the detection of the leading end of the sheet. Alternatively, the exposure to the first one of the linear light patterns of a frame of image is commenced a predetermined time after the detection of the leading end. The choice and/or the delay time is determined in accordance with the length of the conveyance path from the location of the sensor arm 24*a* to the transfer section 45 and the distance along the cylindrical surface 41*a* from the location of the exposure device 43 to the transfer section 45.

The sheet 2 onto which the toner image has been transferred is separated from the photosensitive drum 41. The separation of the sheet from the drum 41 is ensured by a separation tape 13, the exit roller 14, and a tape holding roller 15.

The separation tape 13 is provided at one edge of the cylindrical surface 41*a* outside the area in which the image is formed, so that it does not obstruct the transfer of the toner image. The tape holding roller 15 is short in the direction of the axis of the photosensitive drum 41 and extends to cover only the width of the separation tape 13, so that it does not damage the toner image having been transferred to the sheet 2. The tape holding roller 15 is pressed against the exit roller 14 to pinch the tape 13 between it and the exit roller 14. The separation tape 13 is interposed between the above-mentioned one edge of the cylindrical surface 41*a* and one edge of the sheet 2 so that as the sheet 2 proceeds, the sheet 2 must follow the separation tape 13 and is therefore separated away from the cylindrical surface 41*a*.

The exit roller 14 is provided to move forward the sheet having been separated from the drum 41. The sheet 2 is then conveyed by a conveying belt 17 to the fixing device 16, where the toner image on the sheet 2 is fixed. The sheet is then discharged out of the upper cover 1*a*, to a stacker, not shown, from which the user can take out the sheet easily.

The relationship between the length of the sheet and the distances, along the conveyance path, between rollers which drives the sheet is such that the leading end of each sheet is clamped by a drive roller before its trailing end clears and ceased to be driven by another roller. For instance, the sheet is long enough so that the leading end reaches the register rollers 8*a* and 8*b* before the trailing end of the sheet clears the pick-up roller, and the front end reaches the exit roller 14 before the trailing end clears the register roller 8*a* and 8*b*.

Figure 3:
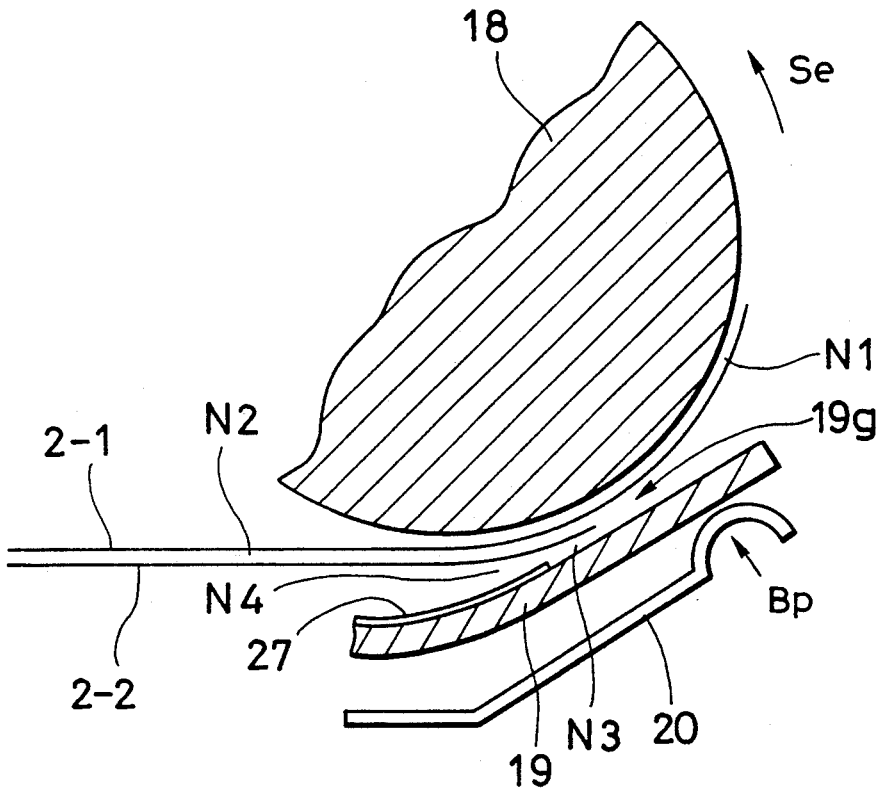
FIG. 3 shows is a partial enlarged view of a modification of the separation mechanism.

In the embodiment described, at the time of the entry of the sheet 2 into the separation mechanism 21, the sheet 2 may be bent by friction with the friction piece 19 and jamming may occur in the sheet accepting cavity 19*e*. In order to solve the problem, as shown in FIG. 3, the friction piece 19 may be covered with a slidable film (or layer) 27 of a low friction material in the area where the sheets 2 initially come into contact with the friction piece 19, up to the vicinity of the gap 19*g*, so the sheet will not be bent. The friction N3 necessary to prevent the passage of the lower sheet is given by the contact between the leading end of the sheet and the exposed part of the friction piece near the gap 19*g*, i.e., the part not covered by the slidable film 27.

An example of the material suitable for the film 27 is polyester film.

In the embodiments describe above, the sensor 24 is disposed between the separation mechanism 21 and the register rollers 8*a*, 8*b*, but it may be provided between the register rollers 8*a*, 8*b* and the transfer section 45.

In the embodiments described, the sheets are supplied by a pick-up roller. In place of the pick-up roller with the cassette, any other type of sheet supply means may be used.

In the embodiments described above, a photosensitive drum 41 is used, and a toner image is transferred from the photosensitive drum 41 to the sheet. The invention is applicable to a system in which writing of image onto the sheet is achieved by any other means, e.g., by use of a thermal head, or an ink-jet print head. The term "writing section" as used in the claims should be construed to encompass any of these types of writing or printing means.

. The term "copier" as used in the claims should be construed to embrace telecopiers and printers.

As has been described according to the invention, a sheet separation mechanism is provided between the sheet supply means and the writing section, so when a plurality of sheets are picked up in superposition, the sheets are separated into ones at the separation mechanism, before they are fed to the writing section. Accordingly, sheet jamming is prevented. In addition, the sensor detects the passage of the sheet at a location between the separation mechanism and the writing section, so the initiation of the writing onto the sheet is timed in accordance with the detection of the leading end of the sheet by the sensor, and the synchronism between the paper feed and the writing is thereby maintained.

What is claimed is:

1. A copier comprising a sheet supply means for supplying a plurality of sheets in succession and a writing section wherein an image is written on a one of the plurality of sheets, said copier further comprising:

(a) a sheet separation mechanism disposed between the sheet supply means and the writing section to separate the plurality of sheets into individual sheets when the plurality of sheets are supplied in superposition from the sheet supply means, said sheet separation mechanism comprising:

i. a drive roller having a cylindrical surface;

ii. a friction piece having a surface facing the cylindrical surface of the drive roller;

iii. means for pressing the fraction piece against the cylindrical surface of the drive roller;

iv. a sheet accepting cavity being defined by said cylindrical surface of the drive roller and said surface of the friction piece on an entry side on which the plurality of sheets supplied from the sheet supply means are received;

v. a gap being formed by said surface of the friction piece and said cylindrical surface of the drive roller, the plurality of sheets being allowed to pass through the gap one at a time;

vi. a slidable film attached to or a slidable layer formed on part of said surface of the friction piece to cover the area of the friction piece where the one of the plurality of sheets initially comes into contact with the friction piece, while the area near the gap is not covered with the slidable film or slidable layer, to give the required friction;

(b) a sheet sensor producing a signal indicative of the passage of the sheet through a predetermined location between the sheet separation mechanism and the writing section; and a control means for controlling the timing of the writing such that the initiation of the writing is in time with the arrival, at the writing section, of the leading end of the area of the one of the plurality of sheets in which the image is to be written.

2. The copier of claim 1, further comprising means for guiding the one of the plurality of sheets picked up by a pick-up roller toward said sheet accepting cavity.

3. The copier of claim 1, wherein said sheet supply means comprises a pick-up roller for picking up the plurality of sheets one by one from a stack of cut sheets contained in a cassette.

4. The copier of claim 1 wherein the friction between the drive roller and the one of the sheets is greater than the friction between the friction piece and the sheet, the friction between the drive roller and the one of the sheets is greater than the friction between the plurality of sheets superposed with each other, and the friction between the friction piece and the one of the sheets is greater than the friction between the plurality of sheets superposed with each other.

5. The copier of claim 1 wherein said friction piece is so disposed that said surface of the friction piece is at an oblique angle to a direction of travel of the one of the sheets.

* * * * *

UNITED STATES PATENT AND TRADEMARK OFFICE

CERTIFICATE OF CORRECTION

PATENT NO. : 5,293,204

DATED : March 8, 1994

INVENTOR(S) : Hiroshi Tabuchi

It is certified that error appears in the above-indentified patent and that said Letters Patent is hereby corrected as shown below:

Col. 3, line 42, "Be" should be --by--.

Signed and Sealed this

Ninth Day of August, 1994

Bruce Lehman

*Attest:*

BRUCE LEHMAN

*Attesting Officer*

*Commissioner of Patents and Trademarks*